US005802414A

United States Patent [19]

Nakashima et al.

[11] Patent Number: 5,802,414

[45] Date of Patent: Sep. 1, 1998

[54] DEVELOPING APPARATUS

[75] Inventors: Yoshihiko Nakashima; Togo Kinoshita, both of Wakayama, Japan

[73] Assignee: Noritsu Koki Co., Ltd., Wakayama-Ken, Japan

[21] Appl. No.: 738,313

[22] Filed: Oct. 25, 1996

[30] Foreign Application Priority Data

Oct. 26, 1995 [JP] Japan ..... 7-279015

[51] Int. Cl.[6] ..... G03D 00/00

[52] U.S. Cl. ..... 396/568; 396/578; 396/626

[58] Field of Search ..... 396/568–570, 396/578, 622, 626

[56] References Cited

U.S. PATENT DOCUMENTS

| | | | |
|---|---|---|---|
| 4,367,249 | 1/1983 | Bloom et al. | 118/300 |
| 4,669,847 | 6/1987 | Taniguchi et al. | 396/578 |
| 4,774,547 | 9/1988 | Uchida et al. | 355/27 |
| 5,179,405 | 1/1993 | Osada et al. | 396/626 |
| 5,184,164 | 2/1993 | Kose et al. | 396/578 |
| 5,252,213 | 10/1993 | Ahmad et al. | 210/542 |
| 5,337,113 | 8/1994 | Kagawa et al. | 396/626 |

FOREIGN PATENT DOCUMENTS

| | | | |
|---|---|---|---|
| 443443 | 8/1991 | European Pat. Off. | G03D 13/00 |
| 517209 | 12/1992 | European Pat. Off. | G03D 3/06 |
| 537365 | 4/1993 | European Pat. Off. | G03D 3/06 |
| 645677 | 3/1995 | European Pat. Off. | G03D 13/00 |
| 683431 | 11/1995 | European Pat. Off. | G03D 3/06 |

*Primary Examiner*—D. Rutledge
*Attorney, Agent, or Firm*—Felfe & Lynch

[57] ABSTRACT

A developing apparatus includes a developing tank (2) for developing photosensitive material, an auxiliary tank (3) communicated with the developing tank, a replenishing container (70) communicated with the auxiliary tank and holding therein processing liquid, a replenishing pump (91–94) for feeding the processing liquid from the replenishing container to the auxiliary tank, a replenishing pump operation instructing unit (100B) for activating the replenishing pump in accordance with a condition of the processing tank. The apparatus further includes a detector (**91*a*–94*a*) for detecting a work amount of the replenishing pump, a determining unit (100B**) for determining whether a cumulative value of detected work amount has reached a preset reference work amount or not and a notifying unit for notifying arrival of the cumulative value at the reference work amount in response to the determining unit.

13 Claims, 9 Drawing Sheets

DEVELOPING APPARATUS

BACKGROUND OF THE INVENTION

1. Field of the Invention

The present invention relates to a developing apparatus including a developing tank for developing a photosensitive material. The developing apparatus typically includes also an auxiliary tank communicated with the developing tank, a replenishing container communicated with the auxiliary tank and holding processing liquid therein, and a replenishing pump for feeding the processing liquid from the replenishing container to the auxiliary tank.

2 . Description of the Related Art

As described above, the developing apparatus includes a developing tank for developing photosensitive material such as a photographic film, a print paper or the like. And, this developing tank includes a plurality of separate processing chambers for effecting color developing, bleaching, fixing and stabilizing operations. As the operation proceeds, processing liquid in each processing chamber gradually decreases in amount and also deteriorates in performance thereof, due to evaporation of the liquid by heating by a heater or by taking-out of the liquid from the chamber by the photosensitive material per se in association with the developing process of the material. For this reason, in order to maintain constant the performance of the processing liquid, it is necessary to replenish each processing liquid periodically.

This replenishment is effected by feeding the additional processing liquid ('replenishing liquid' hereinafter) from the replenishing container holding the liquid therein into the auxiliary tank by the action of the replenishing pump. Conventionally, the timing of this liquid replenishing operation from the replenishing container into the auxiliary tank has been determined based on the operating time period of the developing apparatus. However, a certain amount of preparatory time period is needed before the photosensitive material is charged into the developing tank, and in addition, a developing process is not always taking place in the apparatus. For these reasons, it sometimes has happened that the operating time period of the developing apparatus does not match the stay time period of the photosensitive material inside the developing tank. Therefore, the conventional method of determining the timing of the replenishing operation based on the operating time period of the developing apparatus has been neither accurate nor efficient.

On the other hand, with the replenishing operation described above, the replenishing liquid held in the replenishing container decreases correspondingly. And, when the remaining amount of replenishing liquid in the container becomes too small, it becomes necessary to refill the container with new replenishing liquid or to replace this container by a new container filled with new liquid. For this reason, this replenishing container is equipped with a liquid level sensor, so that an alarm is issued when the remaining amount of the replenishing liquid falls below a predetermined value. In response to this alarm, an operator is supposed to carry out, either the refilling operation or the replacement operation of the replenishing container. In the case of the former, the operator will charge into the replenishing container formulated concentrate of the replenishing liquid together with water at a predetermined mixing ratio and then stir this mixture inside the container. With this method, however, the operator is unable to recognize the consumption or remaining amount of the replenishing liquid in the container until such alarm is issued. Therefore, in order to avoid untimely issuance of the alarm in the midst of a developing operation, the operator would often choose to refill the liquid before issuance of the alarm. This means that the determination about timing of effecting the refilling operation of the replenishing liquid to the replenishing container or the replacing operation of the entire container would depend on the operator's experience and/or foresight. While an experienced operator could manage it, an inexperienced one would find it considerably difficult to estimate or 'feel out' the remaining amount of the replenishing liquid or the number of rolls or sheets of the photosensitive material which may be processed by the amount of liquid remaining in the container. Therefore, it has been desired that the apparatus should somehow assist the operator in making this timing determination.

SUMMARY OF THE INVENTION

A primary object of the present invention is to provide a developing apparatus which allows an operator to easily determine efficient timing of effecting the refilling operation of the replenishing liquid to the replenishing container or replacing operation of the container with a new one.

A further object of the invention is to provide a developing apparatus which allows the operator to grasp accurately the consumption or remaining amount of the replenishing liquid.

For accomplishing the above-noted objects, a developing apparatus according to the invention including a developing tank for developing photosensitive material comprises: detecting means for detecting a processed amount of the photosensitive material relating to the length of the material; determining means for determining arrival of a cumulative value of the detected processed amount of the photosensitive material at a reference processed amount; and notifying means for notifying the arrival of the detected processed amount at the reference processed amount.

The replenishing amount of the developing processing liquid for processing a unit length of the photosensitive material such as a film is fixedly predetermined. Then, based on the length of the photosensitive material detected as the processed amount of this material, it is possible to determine the timing of replenishing operation of the replenishing liquid. Especially, in this respect, if the reference processed amount is caused to correlate with the total capacity of the replenishing container or a plurality of reference processed amounts are provided in correlation with a plurality of unit portions of the total capacity and the notifying means notifies the arrival of the cumulative value at the reference processed amount by means of a lamp, a buzzer or a display on a monitor; then, the operator may recognize the effective timing of the replenishing operation to the replenishing tank or replacing operation of the replenishing tank.

According to a further aspect of the invention, a developing apparatus including a developing tank for developing photosensitive material, an auxiliary tank communicated with the developing tank, a replenishing container communicated with the auxiliary tank and holding therein processing liquid, a replenishing pump for feeding the processing liquid from the replenishing container to the auxiliary tank, and replenishing pump operation instructing means for activating the replenishing pump in accordance with a condition of the processing tank, the developing apparatus comprises: detecting means for detecting a work amount of the replenishing pump; determining means for determining whether a cumulative value of detected work amount has reached a preset reference work amount or not; and notifying means for notifying arrival of the cumulative value at the reference work amount in response to the determining means.

With the above construction, the cumulative work amount is compared with the preset reference work amount. Since the amount of liquid replenished by the replenishing pump can be calculated from the work amount of this pump, it is possible to recognize the remaining processing liquid amount in the replenishing container. Accordingly, by appropriately setting the reference work amount, when a desired remaining liquid amount of the replenishing container is reached, the notifying means notifies this by means of a lamp, a buzzer or a display on a monitor.

If a fixed displacement pump is used as the replenishing pump, the replenishing amount per revolution of the replenishing pump will be fixedly predetermined. Therefore, the remaining amount in the replenishing container may be recognized also by detecting the number of revolutions of this replenishing pump. Namely, the pump revolution amount may be employed as the work amount described above.

Further, for the determination of the timing of refilling or replacing operation of the replenishing liquid to the processing tank, the length of processed photographic material may be utilized.

According to a still further aspect of the invention, the apparatus further comprises a sensor for detecting the kind of the photosensitive material to be introduced into the developing tank. Namely, an appropriate replenishing amount of processing liquid for processing a unit length of photosensitive material may vary, depending on the type of the photosensitive material (e.g. its manufacturer, sensitivity, size, etc.). Then, the replenishing amount may be calibrated properly by detecting such type. As a result, the quality of the processing liquid in the processing tank may be maintained more favorably.

According to a still further aspect of the present invention, a plurality of reference work amounts, e.g. reference revolution amounts, are set in correlation with a plurality of different liquid levels in the replenishing container. Then, the notifying operation by means of a lamp, a buzzer or a display on a monitor is effected for the plurality of different liquid levels in the replenishing container, whereby the maintenance of the replenishing liquid may be effected with greater care.

According to a still further aspect of the present invention, the remaining amount of the replenishing liquid in the replenishing container is calculated from the cumulative revolution amount detected by the detecting means. Then, this remaining amount of the replenishing liquid may be displayed. With this, the operator may recognize the amount of the liquid remaining in the replenishing container, so that he/she may estimate the timing to refill the replenishing liquid or to replace the auxiliary tank by a new one.

According to a still further aspect of the present invention, a processible amount of the photosensitive material is calculated from the cumulative revolution amount detected by the detecting means. Then, this processible amount of photosensitive material may be displayed. With this, the operator may recognize the amount (e.g. the number of rolls, length, etc.) of the photosensitive material which may be processed by the remaining amount of processing liquid.

Further and other objects, features and effects of the invention will become more apparent from the following more detailed description of the embodiments of the invention with reference to the accompanying drawings.

DESCRIPTION OF THE PREFERRED EMBODIMENTS

Preferred embodiments of the present invention will now be described in details with reference to the accompanying drawings.

Figure 1:
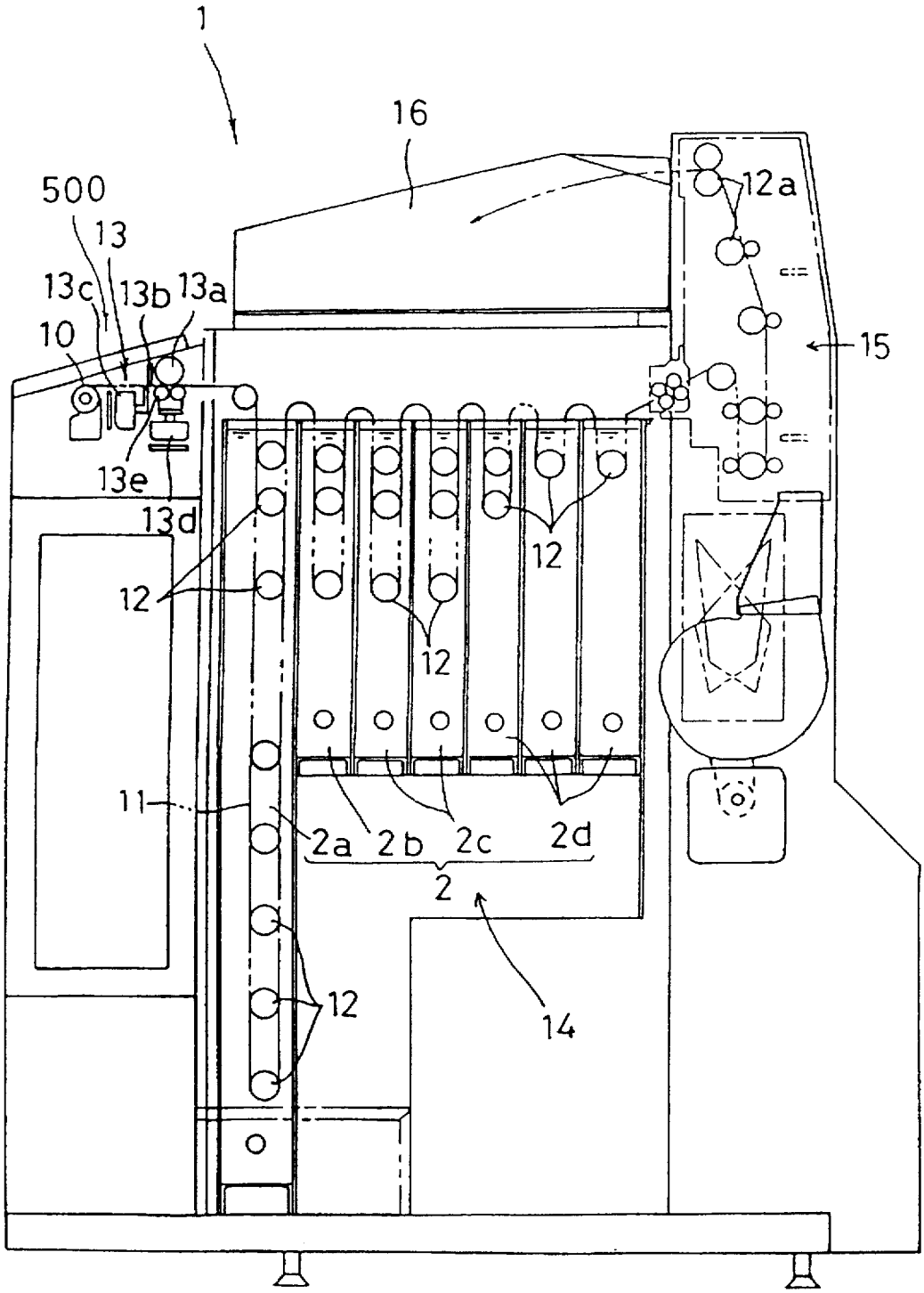
FIG. 1 is a schematic view of an automatic film developing apparatus relating to the present invention.

As shown in FIG. 1, an automatic film developing apparatus 1 includes a film loading section 13 for loading a film 11 (an example of photosensitive material) with a leader connected to a leading end thereof, a film developing section 14 for developing the film 11 fed from the film loading section 13, a film drying section 15 for drying the developed film 11, and a film receiver section 16 for temporarily holding the film 11 after its drying operation. The apparatus 1 further includes a film detecting section 500 for detecting the type of the film.

Next, the respective sections will be described.

The film loading section 13 includes a transport roller 13*a*, a film cutter 13*b* for cutting off a trailing end of the film 11 which has been entirely withdrawn from a film patrone 10, a film cutting solenoid 13*c* for slidably driving one of paired cutter blades of the film cutter 13*b*, a free roller 13*e* operable, under a pressing state thereof, to press the film 11 against the transport roller 13*a*, and a pressing solenoid 13*d* for switching over the free roller 13*e* between the pressing state and a non-pressing state by vertically moving this roller 13*e*. The film 11 entirely withdrawn from and cut off the patrone 10 is transported as being pinched between the transport roller 13*a* and the free roller 13*e* to be introduced into the film developing section 14.

The film developing section 14 includes a processing tank 2 having total 7 (seven) separate tanks for individually holding therein a plurality of kinds of processing liquid such as developing liquid, bleaching liquid, fixing liquid, stabilizing liquid and so on for effecting a series of processing steps such as development, bleaching, fixation and so on. The developing section 14 also includes a plurality of transport roller units 12 for transporting the film 11 within this developing section 14, and an auxiliary tank 3 (not shown in FIG. 3) for replenishing processing liquid to the processing tank 2. The processing tank 2 consists of a color developing (CD) tank 2*a*, a bleaching (BL) tank 2*b*, fixing (FIX) tanks 2*c*, and stabilizing (STB) tanks 2*d*.

Figure 2:
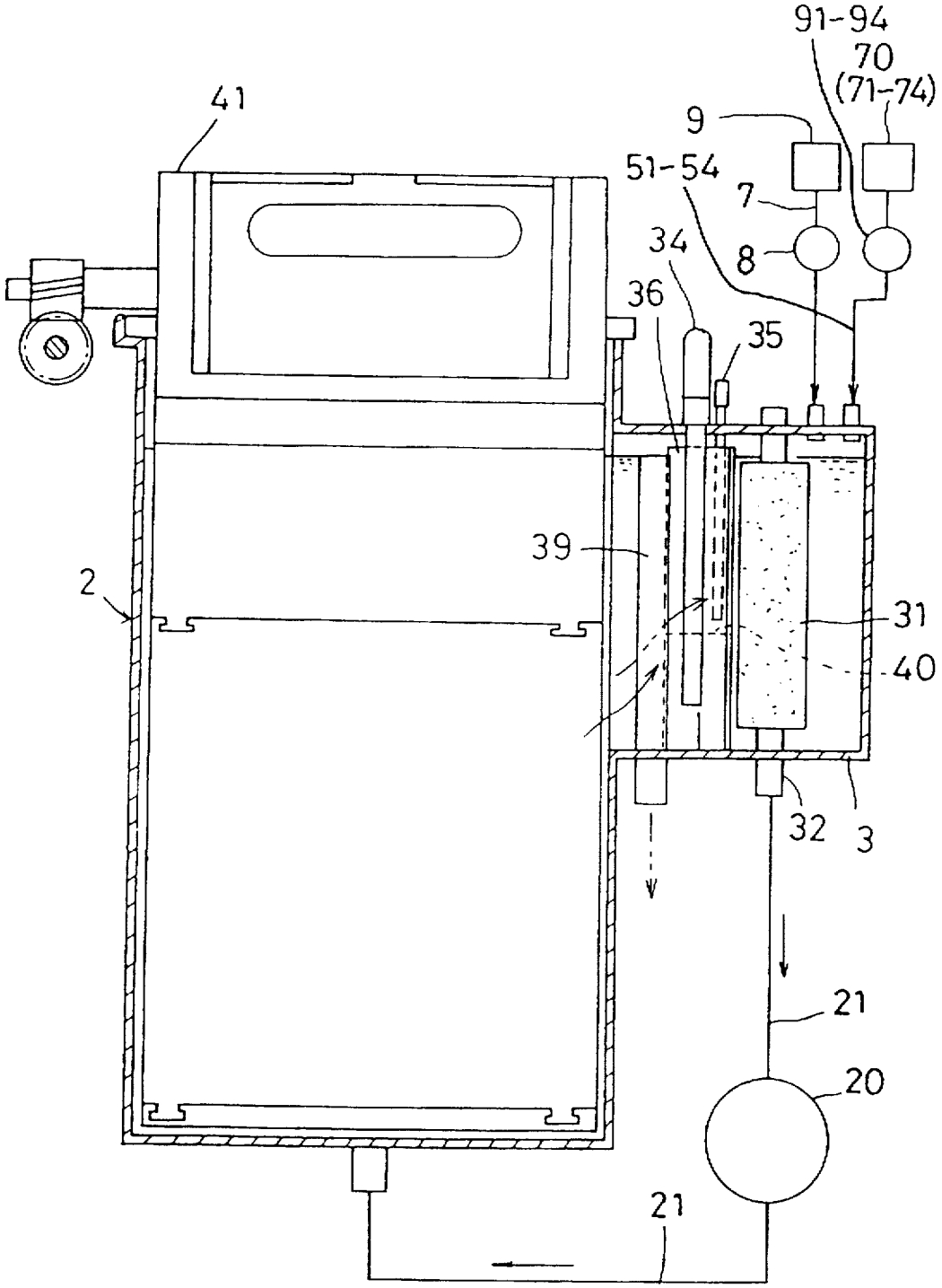
FIG. 2 is a vertical section of an auxiliary tank.

As shown in FIG. 2, the processing tank 2 and the auxiliary tank 3 are communicated with each other via respective upper regions thereof and communicated also at respective bottom regions thereof via a circulating passage 21 incorporating a circulating pump 20 therein.

The circulating pump 20 operates to feed the processing liquid in the auxiliary tank 3 into the processing tank 2 via the circulating passage 21. With this, the processing liquid in the processing tank 2 flows into the auxiliary tank 3, so that there is formed a circulation flow as denoted with solid-line arrows in FIG. 2.

The auxiliary tank 3 incorporates therein a filter 31 for filtering the processing liquid. The filtered processing liquid past this filter 31 then flows through slits 33 defined in a pipe 32 inserted through the filter 31 and flows into the circulating passage 21.

The auxiliary tank 3 further incorporates therein a heater 34 for heating the processing liquid and a temperature sensor 35 for detecting the temperature of the processing liquid. The operation of the heater 34 is controlled based on a detection signal from the temperature sensor 35.

Figure 3:
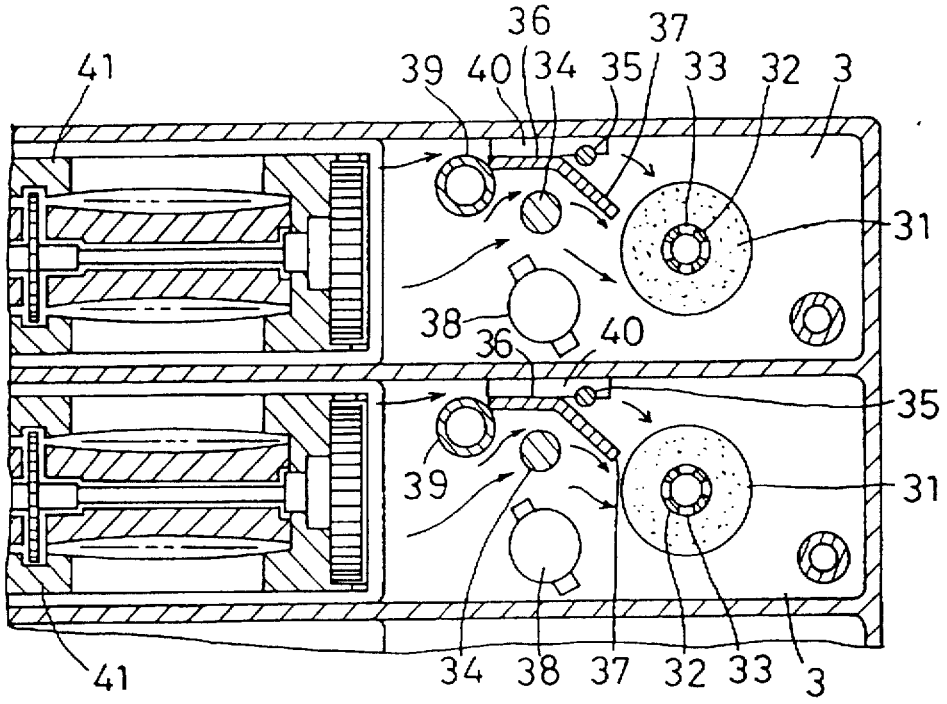
FIG. 3 is a plan view of the auxiliary tank.

The heater 34 and the temperature sensor 35 are disposed side by side relative to the flow direction of the processing liquid across a partitioning plate 36. As shown in FIG. 3, this partitioning plate 36 includes a deflecting portion 37 for deflecting the processing liquid flowing inside the auxiliary tank 3 toward the filter 31.

A guide plate 40 is disposed between a lower portion of the partitioning plate 36 and a lower portion of a side wall of the auxiliary tank 3. This guide plate 40 guides the processing liquid toward the temperature sensor 35 while the liquid is flowing from the processing tank 2 to the auxiliary tank 3, thereby to assure good contact between the processing liquid and the temperature sensor 35.

A rack 41 is provided for guiding the movement of the film 11. A liquid level detecting sensor 38 is provided for detecting the surface level of the processing liquid. Further, in order to maintain the activity of the processing liquid constant, an replenishing pump (to be described later) is activated to refill additional processing liquid into the auxiliary tank 3. An overflow pipe 39 is provided for collecting into an exhaust liquid container exhaust liquid which overflows in association with the refilling operation of the additional liquid.

Incidentally, FIG. 2 shows the cross sectional construction of one processing tank as an example. The other processing tanks too have substantially identical constructions.

The auxiliary tank 3 is connected with a replenishing package 70 via replenishing passages 51–54. The replenishing package 70 includes four replenishing tanks 71–74 which in turn are connected with respective auxiliary chambers 3*a*–3*d*. The replenishing passages 51–54 respectively incorporate therein replenishing pumps 91–94, so that the replenishing amounts to the respective auxiliary chambers 3*a*–3*d*may be controlled independently of each other.

The auxiliary tank 3 is connected also with a plurality of water replenishing tanks 9 via respective water replenishing passages 7. The water replenishing passages 7 are provided in one-to-one correspondence with the auxiliary chambers 3*a*–3*d* and respectively incorporate water replenishing pumps 8 therein.

The replenishing package 70 is an integral assembly integrating the developing liquid replenishing tank 71, the bleaching liquid replenishing tank 72, the fixing liquid replenishing tank 73 and the stabilizing liquid replenishing tank 74. Each replenishing tank 71–74 is equipped with an injection nozzle 80 for discharging the liquid from the tank. On the other hand, a replenishing device 50 includes four liquid feeding nozzles 60 connectable with the respective injection nozzles 80. Then, by mounting the replenishing package 70 to the replenishing device 50 with connecting the injection nozzles 80 of the former to the respective corresponding liquid feeding nozzles 60 of the latter, communications are established between the replenishing tanks 71–74 and the replenishing passages 51–54, respectively. Incidentally, these replenishing tanks 71–74 are filled in advance with predetermined amounts of replenishing processing liquids.

Figure 4:
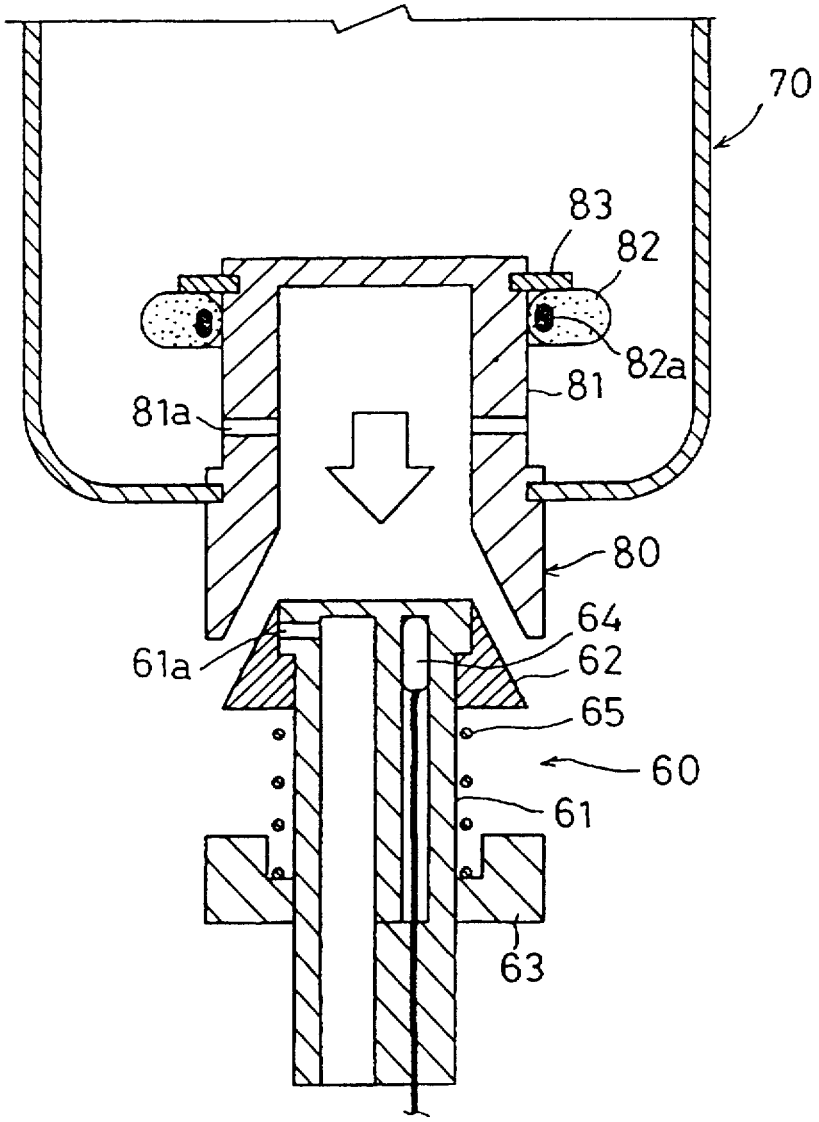
FIG. 4 is an enlarged view of principal portions of a replenishing container.

FIG. 4 shows the injection nozzle 80 of the replenishing package 70 and the liquid feeding nozzle 60 of the replenishing device 50. The injection nozzle 80 includes a cup-shaped nozzle proper 81, a ring-shaped float 82 slidably fitted about an outer peripheral wall of the nozzle proper 81, and a retainer ring 83 attached to the bottom of the nozzle proper 81 for retaining the float 82 against inadvertent withdrawal thereof from the nozzle proper 81. Then, the nozzle proper 81 is inserted to project into the inner space of the replenishing tank. And, the outer peripheral wall of this inserted nozzle proper 81 defines a number of through holes 81*a* for allowing communication between the inside and outside of the replenishing tank 71–74. In the inner peripheral side of the float 82, there is embedded a magnet 82*a*. With the replenishing package 70 being attached to the replenishing device 50, the float 82 is placed in contact with the retainer ring 83 when the replenishing liquid remains at a level higher than the bottom of the nozzle proper 81. When the liquid is diminished in the amount to a level lower than the bottom of the nozzle proper 81, the float 82 drops to this low liquid level.

The liquid feeding nozzle 60 of the replenishing device 50 includes a nozzle pipe 61, a closing ring 62 slidable axially along an outer peripheral face of the nozzle pipe 61, a stopper 63 for this closing ring 62, and a lead switch 64 as a float detecting sensor fitted within an elongate hole extending to the vicinity of the head of the nozzle pipe 61. This head of the nozzle pipe 61 is closed, and instead there are provided a number of liquid feeding holes 61*a* extending through the outer peripheral wall. Further, the head of the nozzle pipe 61 is slightly enlarged in the diameter, so that this head acts also as a retainer for the closing ring 62. The closing ring 62, at an upper end position thereof, closes the liquid feeding holes 61*a*. That is to say, the inner space of the nozzle is opened only when the closing ring 62 is pressed down. A numeral 65 denotes a spring which urges the closing ring 62 toward the upper end position.

When the replenishing package 70 is attached to the replenishing device 50, the injection nozzle 80 presses down the closing ring 62. For this reason, the closing ring 62 has a truncated cylindrical outer peripheral surface and the leading end of the nozzle proper 81 is formed so as to fit this truncated cylindrical outer peripheral surface.

Figure 5A:
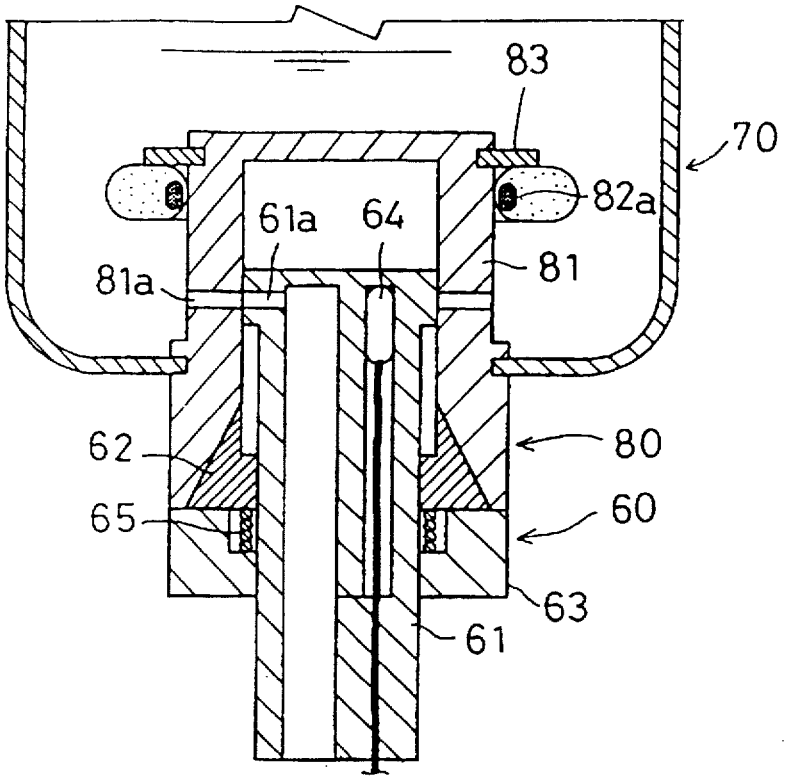
FIGS. 5A, 5B are operation descriptive views of a float sensor.
Figure 5B:
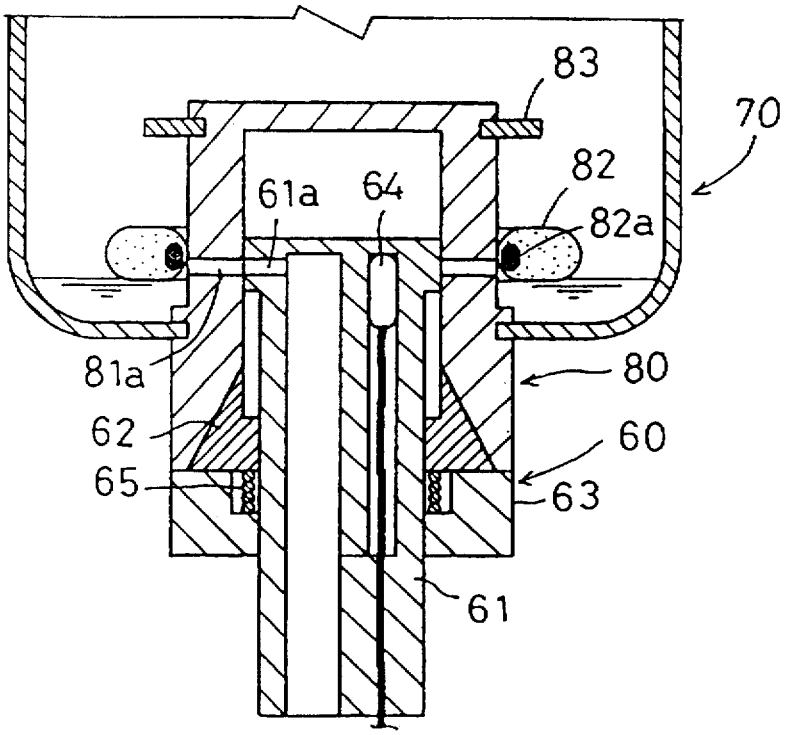

FIGS. 5A and 5B illustrate change in the liquid surface level within each replenishing tank of the replenishing package 70 attached to the replenishing device 50 and associated movement of the float 82. Specifically, FIG. 5A shows a condition where a sufficient amount of replenishing liquid remains within the replenishing tank, i.e. when the liquid surface level is above the bottom of the nozzle proper 81. In this condition, as shown, the float 82 is located in abutment against the retainer ring 83 by effect of the floating force. FIG. 5B shows a further condition where the replenishing liquid in the tank has diminished, i.e. the liquid surface level has dropped below the bottom of the nozzle proper 81. In this condition, as shown, the float 82 has moved down to the vicinity of the lead switch 64. With this, the lead switch 64 responds to the magnet 82*a* of the float 82, whereby exhaustion of the liquid in the tank may be detected.

Figure 6:
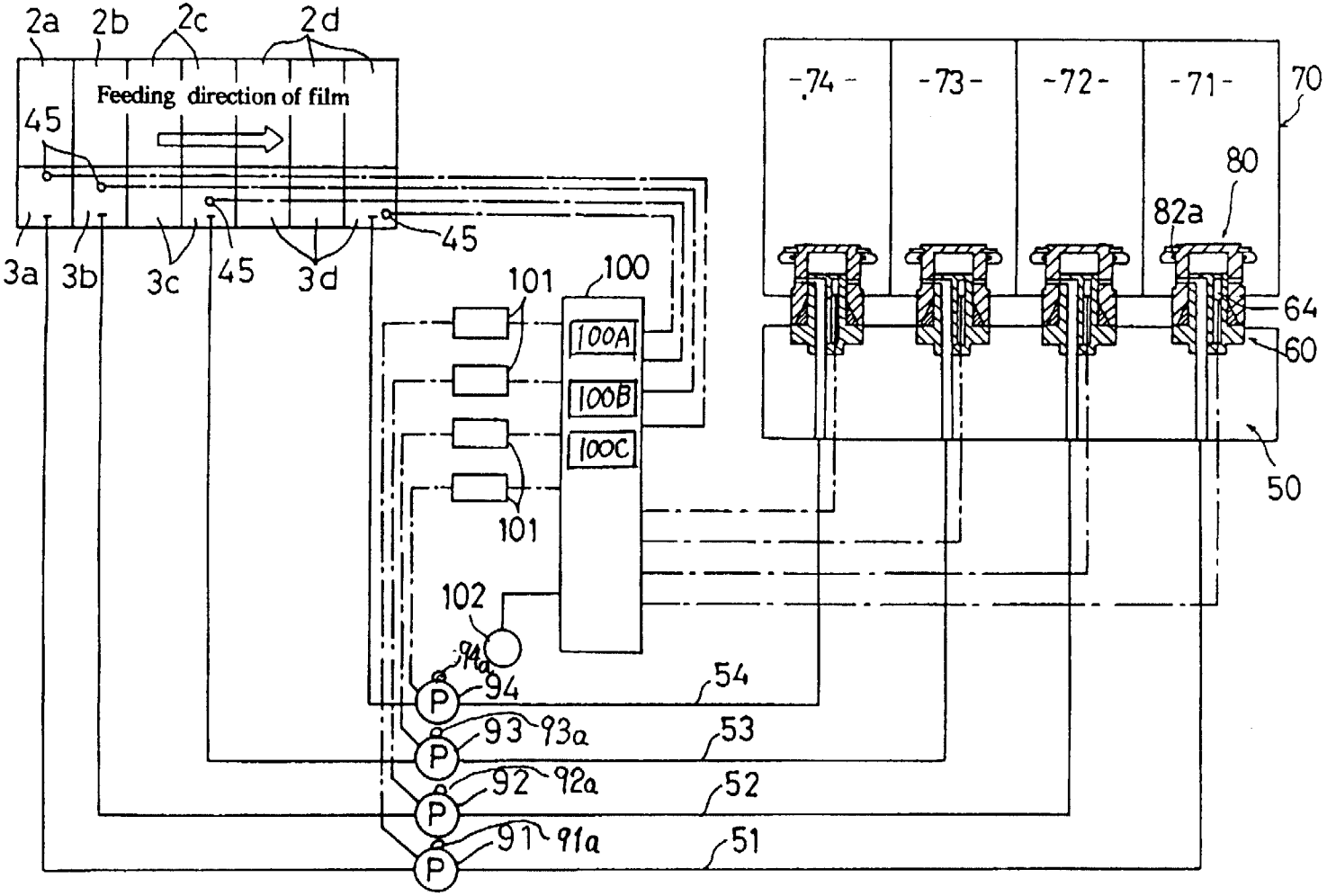
FIG. 6 is an overall block diagram of the automatic film developing apparatus.

Next, the liquid exhaustion detection control using the float sensor system described above will be described in details with reference to a block diagram of FIG. 6.

The liquid level sensors 45 provided for the auxiliary chamber 3*a* of the color developing liquid tank 2*a*, the auxiliary chamber 3*b* of the bleaching liquid tank 2*b*, the auxiliary chamber 3*c* of the fixing liquid tank 2*c* and the auxiliary chamber 3*d* of the stabilizing liquid tank 2*d* are all connected to a digital control device 100 comprised mainly of a microcomputer. Based on a signal transmitted from each liquid surface level sensor 45, the control device 100 can recognize which of the developing liquid, bleaching liquid, fixing liquid and stabilizing liquid chambers is running short of the liquid. Further, those auxiliary chambers 3*a*, 3*b*, 3*c* and 3*d* having the liquid level sensors 45 include discharge openings of the respective replenishing passages 51–54. The other ends of these replenishing passages 51–54 are connected with the liquid feeding nozzles 60 for the respective replenishing liquids of the replenishing device 50 and these passages 51–54 also incorporate therein the replenishing pumps 90–94. The operations of these pumps 91–94 are controlled via respective pump drivers 101 by the control device 100. For instance, in order to maintain constant the activity of the processing liquid, the replenishing pump 91 is driven in accordance with the type and/or length of the film, so as to replenish fresh processing liquid from the replenishing tank 71 to the corresponding auxiliary tank 2*a*. The replenishing pumps 91–94 include revolution detectors 91*a*–94*a* for detecting revolutions of the respective pumps 91–94 and these detectors 91*a*–94*a* are connected with the control device 100.

The control device 100 is connected also with each lead switch 64 disposed within the liquid feeding nozzle 60 of the replenishing device 50 so as to respond to the magnet 82*a* when the float 82 attached to the injection nozzle 80 of the replenishing package 70 has moved downwards. Accordingly, when the liquid of any one of the replenishing tanks 71–74 has been exhausted and the corresponding lead switch 64 transmits a float detection signal to the control device 100, the control device 100 activates an alarm device 102 such as a buzzer, a lamp or the like, thereby to notify the user of necessity of replacement of the replenishing package 70.

The amounts of replenishing liquids held in the respective replenishing tanks 71–74 together constituting the package 70 are known in advance. Also, each replenishing amount is fixedly determined for a predetermined unit length of the film 11. Accordingly, it is possible to determine the length of the film 11 which may be processed in the respective replenishing tanks 71–74.

Next, with reference to FIGS. 6, FIGS. 7A, 7B and FIGS. 8A, 8B, a control scheme for controlling the replenishing liquid and a checking operation of the replenishing amount will be described. In the following description, of the processing tank 2, the color developing tank 2*a* will be taken as an example.

Figure 7A:
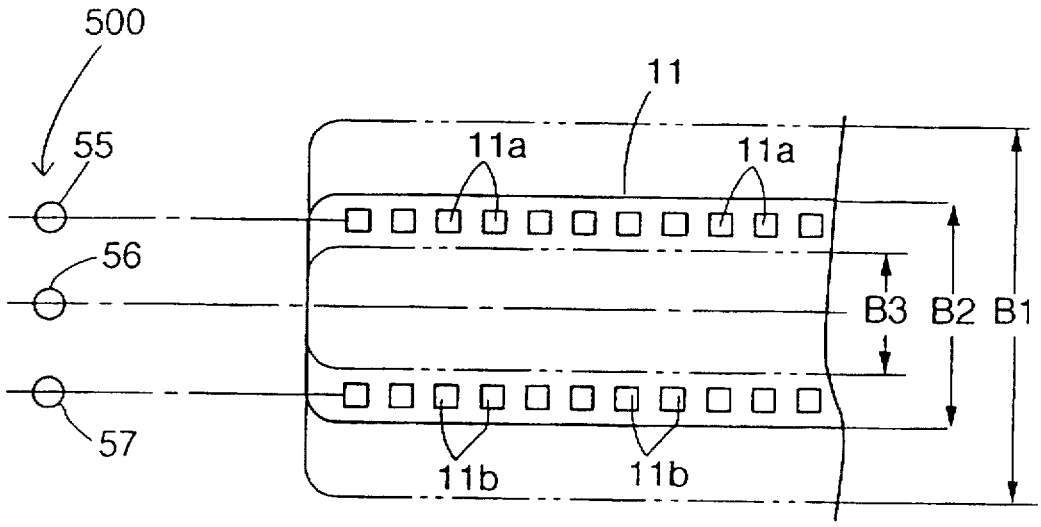
FIG. 7 is a diagram illustrating positional relationship between film detecting sensors and a film.
FIG. 7B is an enlarged view of the film detecting sensors.
Figure 7B:
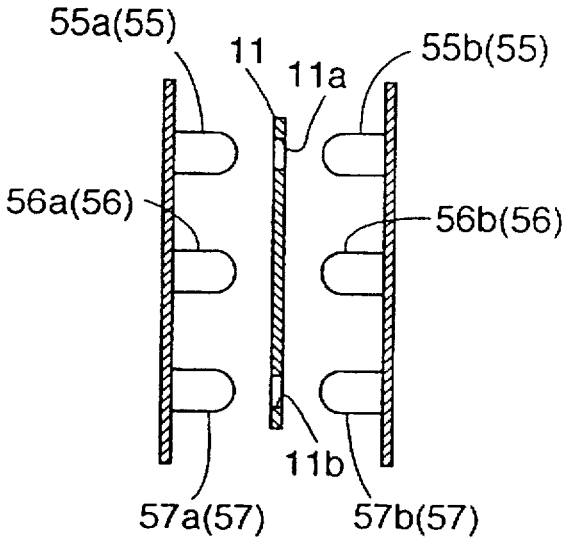

When the film 11 is loaded into the film loading section 13 of the automatic film developing apparatus 1, the film detecting section 500 detects the type of this film 11 before the film 11 is forwarded to the developing tank 2. As may be apparent from FIGS. 7A and 7B, this film detecting section 500 includes film detecting sensors 55, 56, 57 disposed along the width direction of the film 11. These film detecting sensors 55–57 respectively include beam emitters 55*a*, 56*a*, 57*a* comprised of infrared beam emitting diodes and beam receivers 55*b*, 56*b*, 57*b* comprised of infrared sensors and the sensors 55–57 are connected with the control device 100. Then, by evaluating various combinations of signals from these three film detecting sensors 55–57, the control device 100 can distinctly recognize films 11 of differing widths B1, B3, B3 as illustrated in FIG. 7A. Further, the film detecting sensors 55 and 57 are capable also of detecting presence/absence and/or spacing of perforations 11. So that, based on these data relating to the width of the film 11 and to its perforations 11*a*, the control device 100 can determine the type of this film 11. Incidentally, if magnetic data are recorded in the film 11, a magnetic head may be provided instead of the above-described optical type sensors to read such magnetic data for determining the type of the film 11.

The control device 100 provides a variety of functions which are realized by computer programming. Of these functions, a replenishing pump control routine illustrated in FIG. 8A and a replenishing amount checking routine illustrated in FIG. 8B will be described next.

Figure 8A:
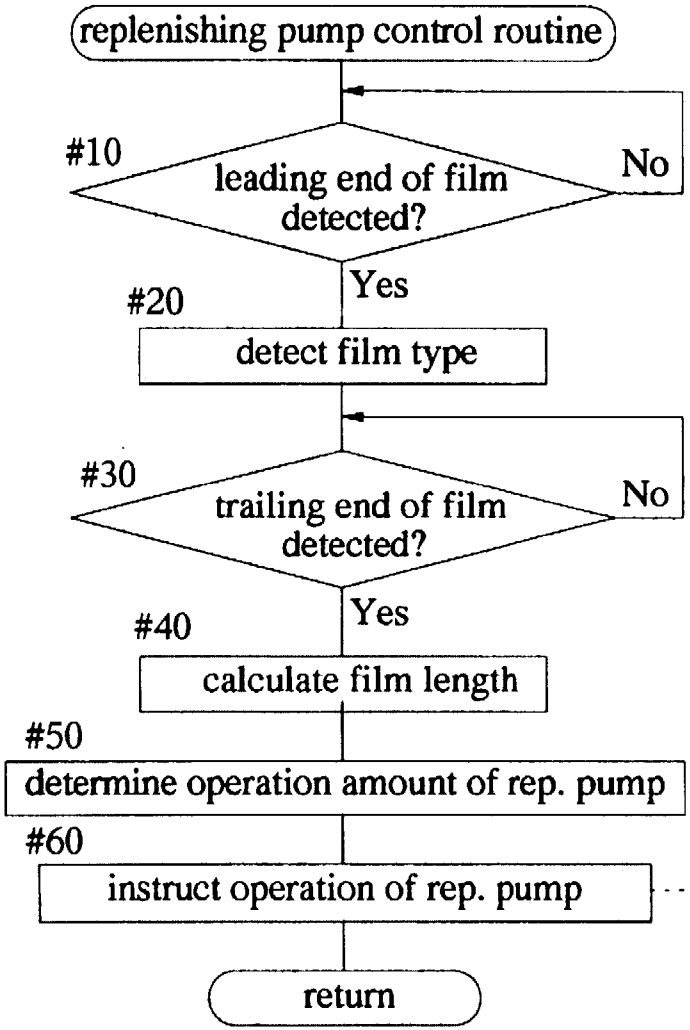
FIG. 8A is a flow chart illustrating a replenishing pump control routine.

When the film 11 is withdrawn from the patrone 10 and its leading end passes across the film detecting section 500, the beams transmitted from the beam emitters 55*a*–57*a* to the beam receivers 55*b*–57*b* are interrupted. Then, signals outputted from these interrupted beam receivers 55*b*–57*b* are utilized for detection of the leading end of the film 11 in case the replenishing pump controlling routine illustrated in FIG. 8A is under operation (step #10). Then, the type of this film 11 is determined based on the results of the outputs from the respective film detecting sensors 55–57 (step #20). Thereafter, the control device 100 evaluates the detection signals outputted from the film detecting section 500 for the film 11 and counts the number of the perforations 11*a* based on detection signals relating to the perforations 11*a* provided to the film 11. Further, the control device 100 checks whether the trailing end of the film 11 has been detected or not (step #30). When the detection of the trailing end of the film 11 has been confirmed, it is determined that the entire roll of the film 11 has been charged into the color developing tank 2*a* of the processing tank 2. Thereafter, the film 11 is caused to advance through the respective tanks 2*a*–2*d* one after another to be subjected to the predetermined treatments.

When the trailing end of the film 11 is confirmed, the length of the film 11 is calculated (step #40). This calculation is made based on the total number of counted perforations 11*a*. This is possible because the spacing between the adjacent perforations 11 is fixedly predetermined by the established industrial standard. Alternatively, in the case of a film 11 having no perforations 11*a*, the length of this film 11 may be determined, based on a time period between the detection of the leading end of the film 11 and the detection of the trailing end thereof. This is possible because the film 11 is transported at a substantially fixed speed in the apparatus. Hence, the length of the film 11 may be calculated by measuring the time period with using a timer or the like. The control device 100 provides, as one of its various functions realized by programming, calculating means 100A for effecting this function of calculating the length of the film 11. The appropriate replenishing amount for a unit length (or predetermined length) of the film 11 is determined in advance in correlation with the type of the film 11. Then, based on this calculated length and detected kind of the film 11, an operation amount, i.e. the replenishing amount, of the replenishing pump 91 is determined (step #50) and an operational instruction based on the determined replenishing amount is given to the replenishing pump 50 (step #60).

Figure 8B:
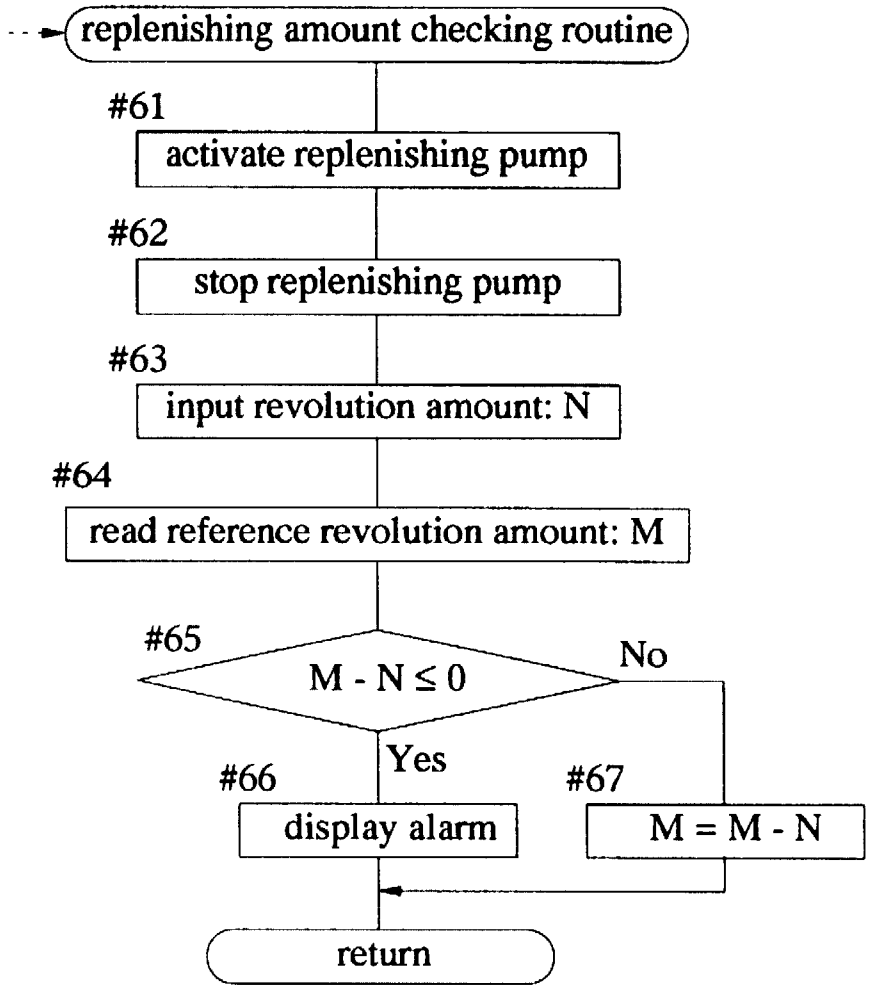
FIG. 8B is a flow chart of a replenishing amount checking routine.

When the operational instruction is given to the replenishing pump 91, then, the control device 100 initiates the replenishing amount checking routine illustrated in FIG. 8B. Upon this, the replenishing pump 91 is operated via the pump driver 101 by the operational amount corresponding to the determined replenishing amount (step #61) and then stopped (step #61). In the instant embodiment, the replenishing pump 91 is constructed as a fixed displacement pump. This means that the replenishing amount per revolution of the pump is fixed and the replenishing amount is a function of the number of the pump revolutions. Therefore, the replenishing amount may be accurately derived from the number of pump revolutions. For this reason, when the replenishing pump 91 is activated, the number of pump revolution is counted by means of the revolution detector 91*a* provided for each replenishing pump and constructed from a hole IC and a magnet in this embodiment. When the pump 91 is stopped, the counted number of revolution: N is inputted to determining means 100C (step #63), and this is compared with a reference revolution number M which is read from a non-volatile memory (step #65). More specifically, it is determined whether a difference: M–N has become smaller than '0' (zero) or not. This determining means 100C is another programmed function of the control device 100. Incidentally, as the revolution detector 91*a* for detecting the revolution number of the replenishing pump 91, in place of the combination of a hole IC and a magnet, other types of detector constructions such as an optical encoder or the like may be employed as well.

If it is determined at step #65 that the difference: M–N has not yet become smaller than '0', then, a new reference revolution number: M=M–N is written into the non-volatile memory (step #67), and then the process returns from this routine. With this, the set, i.e. reference revolution number: M is decremented with each activation of the replenishing pump 91. By subtracting the new reference revolution number: M written into the non-volatile memory at step #67 from the original reference revolution number: M, there is obtained a cumulative revolution number of the replenishing pump 91 which has been counted from the previous refilling of the replenishing tank 71. Further, from this cumulative revolution number, a cumulative processed amount of the film 11 and also a consumption amount of the replenishing liquid in the tank 71 may be derived. Moreover, since the original amount of the replenishing liquid in the replenishing tank 71 is known in advance, the remaining amount of the replenishing liquid in the tank 71 may be derived from the consumption amount. Then, by displaying these data of the consumption amount and remaining amount of the replenishing liquid on a monitor 102 as an embodiment of notifying means, an operator may recognize the timing to refill replenishing liquid to the replenishing tank 71 or the timing to replace the entire replenishing tank 71 with a new one. The means for calculating the consumption amount and remaining amount of the replenishing liquid is incorporated within the control device 100.

Also, from the remaining amount of the replenishing liquid, it is possible to recognize a remaining processible amount of the film 11. And, by displaying this remaining processible amount, the operator may recognize also an amount of film 11 which may be processed by the remaining amount of the replenishing liquid.

On the other hand, if the difference: M–N has become smaller than '0' at step #65, the monitor 102 is caused to display an alarm notice (step #66). With this, the operator may recognize that additional replenishing liquid should be refilled to the replenishing tank 71 or the entire replenishing tank 71 should be replaced by a new one.

Instead of the monitor 102 for displaying the alarm notice, the notifying means 102 may be constructed alternatively as other type of visual notifying means comprised of a lamp, an LED or the like or audio type notifying means such as a buzzer.

Incidentally, as described hereinbefore, the reference revolution number: M, is preferably set as the initial amount of replenishing liquid initially charged in the replenishing tank 71. Instead, however, a plurality of reference revolution numbers of the replenishing pump 91 may be provided in correlation with a plurality of unit portions of the initially charged amount, so that an alarm is issued each time the actual pump revolution number exceeds each reference revolution number. In this case, the alarm is displayed each time the liquid in the replenishing tank 71 has dropped to a predetermined intermediate lower level.

The above description relates to the replenishing tank 71 connected with the color developing tank 2*a* and its auxiliary chamber 3*a*. The same description applies also to the other processing tanks 2*b*–2*d*. In these cases, the timing when e.g. the film 11 is charged into the subsequent bleaching tank 2*b* from the color developing tank 2*a* may be recognized by means of the afore-mentioned timer which is activated upon detection of the leading or trailing end of the film 11. This is possible because the film 11 is transported at a fixed rate within the developing tank 2 so that it is possible to expect the film 11 to reach the subsequent bleaching tank 2*b* with lapse of a predetermined time period after the detection of its leading or trailing end. The same may be applied also to the other fixing tank 2*c* and stabilizing tank 2*d*. Alternatively, the film detecting section may be provided to each of the processing tanks 2*a*–2*d*.

[other embodiments]

(1) The reference processed amount may be caused to correlate directly with a value corresponding to the processed length of the film 11, rather than with the revolution number of the replenishing pump 91–94. In such case, the length of the film 11 detected at the film detecting section 500 is calculated to obtain its cumulative value. Then, when this cumulative value has reached a predetermined value, an alarm will be issued. Accordingly, it is not necessary, in this case, to detect the revolution number of the replenishing tank 91–94.

Figure 9:
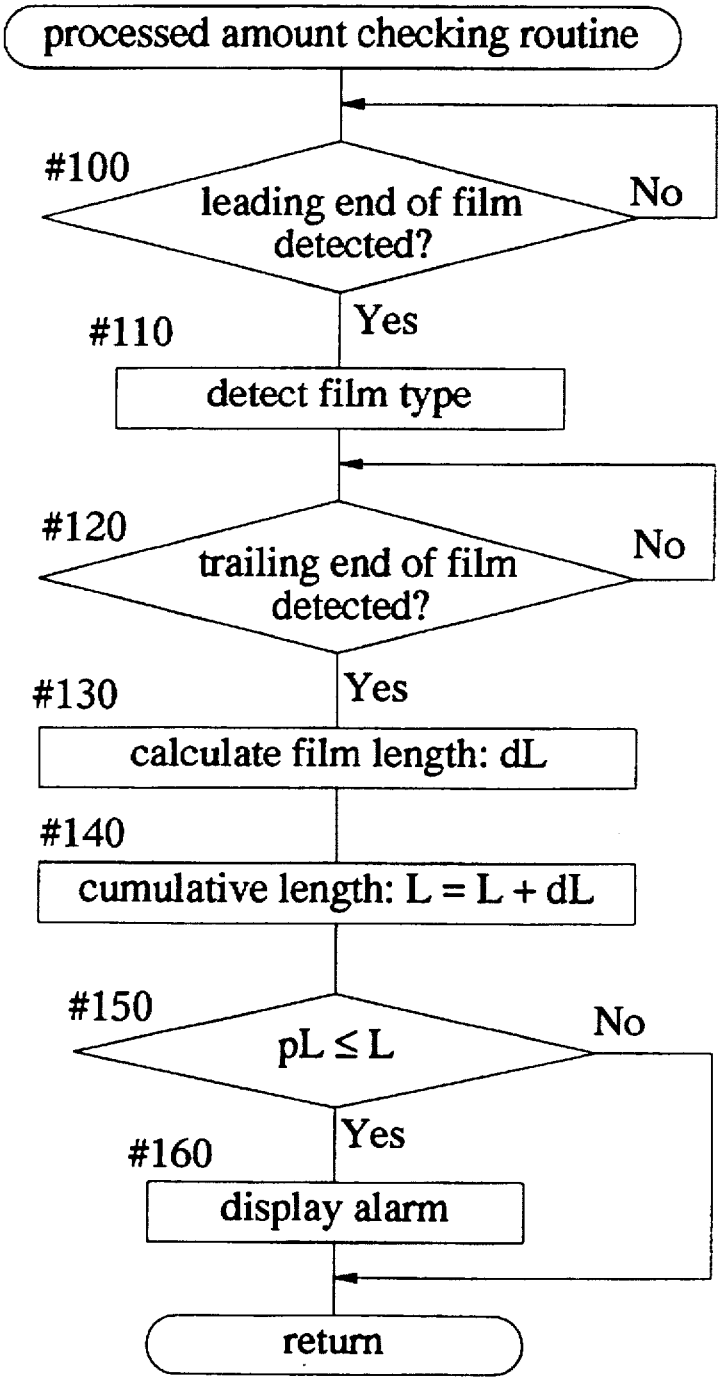
FIG. 9 is a flow chart illustrating the routine employed for checking a processed amount.

A processed amount checking routine employed in this alternative construction will be described next with reference to a flow chart of FIG. 9.

When the leading end of the film 11 is detected at the film detecting section 500 (step #100), the process begins to count the number of perforations 11*a* by using the detection signals on the perforations 11*a* of the film 11 and simultaneously therewith the type of this film 11 is determined based on the results of the outputs from the respective film detecting sensors 55–57 (step #110). When the trailing end of the film 11 is detected (step #120), a film length: dL is calculated from the number of the counted perforations 11*a* (step #130). This calculated film length: dL is added to a cumulative length variable: L which stores the cumulative, i.e. total film length detected (step #140). In the course of this, if the detected film type is of a special type which consumes a greater amount of processing liquid than the standard type, the film length: dL may be calibrated by comparison with the standard film. This added-up cumulative film length is the total length of the film(s) which has been measured from a previous resetting operation (which is effected at the time of replacement of the replenishing package 70 or refilling of the liquid to the package 70). If at step #150 this cumulative length variable: L is not greater than a preset reference processed amount: pL; then, the process once returns. But, when this routine is again called, the process is ready for charging of a next film 11. On the other hand, if at step #150 the cumulative length variable: L has become greater than the preset reference processed amount pL; then, an alarm signal is generated to notify the operator of necessity of e.g. refilling of the replenishing liquid to the replenishing tank 2 (step #160). Needless to say, this alarm signal may be also utilized directly as a trigger signal for driving the replenishing pump 91–94. In this case, the replenishing operation of the liquids to the developing tank 2 may be automatically effected. Accordingly, in this embodiment, the notifying means for notifying arrival of the processed amount at the reference processed amount includes a trigger signal generating means for driving the replenishing pumps 91–94.

Further alternatively, it is also conceivable to set a plurality of reference processed amounts: pL1, pL2 . . . in correlation respectively with a plurality of differing liquid levels. Then, by using these reference processed amounts from the smallest one onward, the alarm signal will be generated in accordance with the processed amount corresponding to the predetermined consumption amount of the replenishing liquid.

(2) The present invention may be applied also to a developing apparatus for developing a print paper, rather than the film 11. Therefore, in addition to the developing function, the developing apparatus of the invention may be provided with a further function of exposing and printing the developed film 11 onto a print paper. Or, the invention may be used in an apparatus for developing print paper alone. (3) In FIG. 8, the decremental counting operation of the set value M is effected for processing of each roll of film 11. Instead, the operation may be effected for a plurality of rolls of films 11.

Further, in the foregoing embodiment, the decremental counting operation is initiated after completion of the operation of the replenishing pump 91–94. Instead, this decremental counting operation may be effected simultaneously with the activation of the pump 91–94. Further alternatively, in place of the decremental counting operation from the set value of the reference processed amount or the reference pump revolution number, the number of revolutions of the replenishing pump 91–94 may be incremented, and when its cumulative value has reached a predetermined set value, an alarm will be issued.

The invention may be embodied in other specific forms without departing from the spirit or essential characteristics thereof. The present embodiments are therefore to be considered in all respects as illustrative and not restrictive, the scope of the invention being indicated by the appended claims rather than the foregoing description and all changes which come within the meaning and range of equivalency of the claims are therefore intended to be embraced therein.

What is claimed is:

1. A developing apparatus comprising:

a developing tank for developing photosensitive material;

detecting for detecting a processed amount of the photosensitive material relating to the length for the material;

determining means for determining arrival of a cumulative value of the detected processed amount of the photosensitive material at a reference processed amount;

notifying means for notifying the arrival of the detected processed amount at the reference processed amount; and a replenishing container for replenishing processing liquid to the developing tank;

wherein a plurality of the reference processed amounts are set in correlation with a plurality of different liquid levels in the replenishing container.

2. A developing apparatus as claimed in claim 1, further comprising:

a sensor for detecting the kind of the photosensitive material to be introduced into the developing tank;

wherein the processed amount detected by the detecting means is varied in accordance with the type of the photosensitive material.

3. The developing apparatus as claimed in claim 2, wherein said sensor detects sensitivity of the photosensitive material.

4. The developing apparatus as claimed in claim 1, wherein the apparatus uses the plurality of reference processed amounts one after another from the smallest one onward, and an alarm signal, is generated in accordance with the processed amount corresponding to a predetermined consumption amount of the replenishing liquid.

5. A developing apparatus comprising:

a developing tank for developing photosensitive material;

an auxiliary tank communicated with the developing tank;

a replenishing container communicated with the auxiliary tank and holding therein processing liquid;

a replenishing pump for feeding the processing liquid from the replenishing container to the auxiliary tank;

replenishing pump operation instructing means for activating the replenishing pump in accordance with a condition of the processing tank;

detecting means for detecting a revolution amount of the replenishing pump;

determining means for determining whether a cumulative value of detected revolution amount has reached a preset reference revolution amount or not; and notifying means for notifying arrival of the cumulative value at the reference revolution amount in response to the determining means.

6. A developing apparatus as claimed in claim 5, further comprising;

detecting means for detecting a processed amount of the photosensitive material relating to a length of the material;

wherein said replenishing pump operation instructing means determines a revolution amount of the replenishing pump in accordance with the detected processed amount.

7. A developing apparatus as claimed in claim 5, further comprising;

a sensor for detecting the kind of the photosensitive material to be introduced into the developing tank;

wherein said replenishing pump operation instructing means varies the revolution amount of the replenishing pump in accordance with the detected type of the photosensitive material.

8. A developing apparatus as claimed in claim 5, wherein a plurality of the reference revolution amounts of the replenishing pump are set in correlation with a plurality of different liquid levels in the replenishing container.

9. A developing apparatus as claimed in claim 5, wherein the remaining amount of the replenishing liquid in the replenishing container is calculated from the cumulative revolution amount detected by the detecting means.

10. A developing apparatus as claimed in claim 5, wherein a processible amount of the photosensitive material is calculated from the cumulative revolution amount of the replenishing pump.

11. The developing apparatus as claimed in claim 7, wherein said sensor detects sensitivity of the photosensitive material.

12. A developing apparatus comprising:

a developing tank for developing photosensitive material;

an auxiliary tank communicated with the developing tank;

a replenishing container communicated with the auxiliary tank and holding therein processing liquid;

a replenishing pump for feeding the processing liquid from the replenishing container to the auxiliary tank;

replenishing pump operation instructing means for activating the replenishing pump in accordance with a condition of the processing tank;

detecting means for detecting a revolution amount of the replenishing pump;

determining means for determining whether a cumulative value of detected revolution amount has reached a preset reference revolution amount or not; and notifying means for notifying arrival of the cumulative value at the reference revolution amount in response to the detecting means;

wherein a plurality of the reference processed amounts are set in correlation with a plurality of different liquid levels in the replenishing container.

13. The developing apparatus as claimed in claim 12, wherein the apparatus uses the plurality of reference processed amounts one after another from the smallest one onward, and an alarm signal is generated in accordance with the processed amount corresponding to a predetermined consumption amount of the replenishing liquid.

* * * * *

UNITED STATES PATENT AND TRADEMARK OFFICE

CERTIFICATE OF CORRECTION

PATENT NO. : 5,802,414

DATED : September 1, 1998

INVENTOR(S) : Nakashima et al.

It is certified that error appears in the above-identified patent and that said Letters Patent is hereby corrected as shown below:

In column 1, line 43, before "match" add --exactly--.

In column 1, line 59, after "out" delete -- , --.

In column 4, line 13, change "7" to --7A--.

In column 7, line 25, change "90" to --91--.

In column 8, line 9, change first occurrence of "B3" to --B2--.

In Claim 1, column 11, line 59, between "detecting" and "for" add --means--.

UNITED STATES PATENT AND TRADEMARK OFFICE

CERTIFICATE OF CORRECTION

PATENT NO. : 5,802,414

DATED : September 1, 1998

INVENTOR(S) : Nakashima et al.

It is certified that error appears in the above-identified patent and that said Letters Patent is hereby corrected as shown below:

In Claim 4, column 12, line 20, after "signal" delete -- , --.

Signed and Sealed this

Tenth Day of August, 1999

*Attest:*

Q. TODD DICKINSON

*Attesting Officer*

*Acting Commissioner of Patents and Trademarks*